US005495985A

United States Patent [19]

Nehm et al.

[11] Patent Number: 5,495,985

[45] Date of Patent: Mar. 5, 1996

[54] JET REGULATOR FOR ATTACHMENT TO SANITARY FITTINGS

[75] Inventors: Holger Nehm; Hermann Grether, both of Mullheim, Germany

[73] Assignee: Dieter Wildfang GmbH, Mullheim, Germany

[21] Appl. No.: 315,698

[22] Filed: Sep. 30, 1994

[30] Foreign Application Priority Data

Oct. 2, 1993 [DE] Germany ..... 9314990 U

[51] Int. Cl.[6] ..... B05B 1/14

[52] U.S. Cl. ..... 239/428.5; 239/432; 239/590.3

[58] Field of Search ..... 239/428.5, 590, 239/590.3, 590.5, 553, 432

[56] References Cited

U.S. PATENT DOCUMENTS

| | | | |
|---|---|---|---|
| 2,624,559 | 1/1953 | Hyde | 239/590.3 X |
| 3,747,856 | 7/1973 | Knapp | 239/428.5 |
| 4,637,552 | 1/1987 | Finkbeiner et al. | 239/428.5 |
| 5,334,247 | 8/1994 | Columbus et al. | 239/590.3 X |

FOREIGN PATENT DOCUMENTS

| | | | |
|---|---|---|---|
| 209818 | 6/1960 | Austria . | |
| 1146816 | 4/1963 | Germany . | |
| 2745657 | 4/1978 | Germany . | |
| 3000799 | 7/1981 | Germany . | |
| 3404662 | 8/1985 | Germany . | |
| 1154697 | 6/1969 | United Kingdom | 239/428.5 |

*Primary Examiner*—Kevin P. Weldon
*Attorney, Agent, or Firm*—Dallett Hoopes

[57] ABSTRACT

Jet regulator and aerator for attachment to a faucet contains a circular perforated plate for producing individual jets, and a coaxial sleeve downstream. The sleeve supports—deflection slopes which are inclined at an angle to the flow direction. The deflection slopes may be in the form of conical-pointed pins aimed at the plate. The pins are mounted on a tiered-wedding-cake shaped wall. An axial cone in the sleeve may also comprise a deflection slope. Additional obstacles consist of pins and/or ribs located at intervals from each other.

20 Claims, 6 Drawing Sheets

JET REGULATOR FOR ATTACHMENT TO SANITARY FITTINGS

BACKGROUND OF THE INVENTION

The invention concern a jet regulator and aerator for attachment he sanitary fittings or the like, with a jet dispersion arrangement including a perforated plate that contains a number of flow holes, which produce individual jets.

A jet regulator of the above described type is already known from DE-PS 30 00 799, which has a perforated plate with a number of flow holes, produce individual jets. The perforated plate of this know jet regulator contains air intake device as well as several jet radiating strainers, which are located downstream in the flow direction. However, the arrangement of a large number of jet regulating strainers is expensive. Good jet regulator are also required to keep any calcification, particularly of the sensitive jet regulating strainers, moderately low. The perforated plate of the jet regulator known from DE-PS 30 00 799 is therefore designed to favor good jet dispersion, and the regulating strainers can be constructed with a correspondingly large mesh. Large mesh regulating strainer keep the danger of clogging and calcification comparatively low.

Another jet regulator has also been created, which contains a first and an immediately following second perforated plate (see DE-OS 34 04 662). The first and the separate second perforated plate contain flow holes, which are staggered with respect to each other. While the first perforated plate is designed to produce individual jets, the second perforated plate produces turbulence in these individual jets, creating the partial vacuum needed to mix in air and slow the individual jets down. Instead of the usual jet regulating strainers, the second perforated plate contains several ring walls placed downstream in the flow direction, which have circular steps or gradations on the inside and outside of the wall sections facing the perforated plates. These steps, which protrude into the paths of the individual jets produced by the perforated plates, are designed to properly disperse the water jets by mixing air into them. Since this known jet regulator does not require any jet regulating strainer, the danger of calcification is eliminated.

However, the jet regulator known from DE-OS 34 04 662 is comparatively large in height, requiring a special housing which can also limit the use of this jet regulator. Furthermore the production and assembly of the two perforated plates requires high accuracy, especially if they have several flow holes that are staggered with respect to each other, which involves considerable expense. To develop low noise in these perforated plates, the flow holes of the first perforated plate must have very sharp edges on their inflow side for example. Such edges, at least such edges of durable nature, are difficult to achieve with injection molded products.

The task therefore exists to create a jet regulator of the above described kind that is not prone to calcification, which can be manufactured at comparatively lost cost, which makes possible the production of a uniform full stream with the lowest possible noise, and still does not exceed the usual height of such jet regulators.

SUMMARY OF THE INVENTION

With the jet regulator of the above-mentioned kind, the fulfillment of this task by the invention consists particularly in that at least some of the flow holes contain a deflection slope at a distance from their outflow side, which is placed at an angle to the flow direction, at least in the area of one of the individual jets, and that this deflection slope or these deflection slopes are followed by flow obstacles in the form of pins and/or ribs located at a distance from each other in the outflow direction.

The jet regulator of the invention also produces individual jets with only one perforated plate. Instead of the usual jet regulating strainers, which are prone to calcification and clogging, the jet regulator of the invention has pins and/or ribs located at a distance from each other, approximately oriented in the longitudinal direction of the jet regulator. These flow obstacles, toward which the individual jets are aimed via deflection slopes, disperse the individual jets well and can also mix them with air. In addition, the high flow velocity of the individual jets is first slowed down in the desired manner by the intercepting deflection slopes, and then also by the pins and/or ribs, without creating any significant noise. Since, as a rule, the jet regulator of the invention has only one perforated plate, the high cost involved with the staggered use of two perforated plates is avoided, and the jet regulator of the invention can be produced with an unusual compactness of height.

A preferred configuration of the invention provides that the distal or free ends of the pins point towards the perforated plate, and that at least the upper or distal ends of the pins located in the outflow area, or in the outflow direction of the flow holes, embody a deflection slope. In this particularly compact and simple configuration, at least the distal ends of the pins located in the outflow area of the flow holes are shaped as deflection slopes. For example, these deflection slopes on the ends of the pins may be formed so that the distal end areas of all the pins taper towards the perforated plate, and that these open end areas are preferably conical. A pyramid-shaped or hemispherical bevel is possible, for example, instead of a conical pin end.

It is useful if at least some of the pins located in the outflow area, or in the outflow direction of the flow holes, are staggered with respect to the flow holes, preferably they are arranged in a radial stagger towards the inside. The inward staggered arrangement of the pins located in the outflow area of the flow holes deflects the individual jets toward the outside, where they impact against other pins and/or ribs. The pins and ribs can be properly placed in this outer ring-shaped area, at a sufficient distance from each other. In this instance it is useful if the pins downstream of the deflection slope or bevels are placed at different distances from each other, at least in a partial area of the jet regulator, and preferably are staggered with respect to each other along the longitudinal axis of the jet regulator. In this way, the pins practically form labyrinth-shaped flow obstacles which disperse and slow down the individual jets particularly well, so that they can be mixed with incoming air.

If the flow holes, or at least a portion of the flow holes, are arranged in a small circle on the perforated plate, it is useful if they are assigned a common deflection slope, which preferably is the front of a round and/or concentric ring wall that faces the perforated plate.

It is generally advantageous if the perforated plate is followed by at least one ring wall in the flow direction, which tapers in the direction of the perforated plate, at least in the area that faces the perforated plate. The tapered area of this ring wall guides the individual jets and also slows them down. In this instance it is useful if pins are located in the tapered area on the outside of at least one ring wall, and a circular channel is located between the ring wall and an adjacent ring wall, on the inside wall of the jet regulator and/or a central body coaxially located along the longitudinal axis of the jet regulator.

The desired slowdown or dispersion and mixing effect in the individual jets flowing past the ring wall can be enhanced if at least one ring wall has steps or cascade-shaped gradations on the outside and/or inside wall, at least in the area that faces the perforated plate.

A preferred configuration of the invention provides that ribs are located on the inside wall of the jet regulator and/or on the inside of at least one ring wall, and preferably extend in the radial direction. The individual jets flowing towards the inside of this ring wall are caught in this rib area, are again slowed down, possibly are also mixed with air, and continue in the flow direction. It can be advantageous if the inwardly facing ends of at least a portion of the ribs which are oriented in the flow direction is located at a distance from a neighboring ring wall or from the central body. The thickness of the ribs can be made comparable to the diameter of the pins located on the neighboring ring wall. Also, thicknesses of the ribs may be similarly sealed.

In the design of a mold to produce the product it may help if all wall surfaces are slightly tapered to facilitate removal from the mold.

To be able to join the outer jacket of the jet regulator to the inside ring walls in a simple single-piece manner, it is useful and preferred if at least some of the ribs are radially attached to cross pieces, which connect the inside of the jet regulator wall, or a ring wall, to an opposing ring wall, or to the central body.

The production of a homogeneous full stream after flowing through the jet regulator is benefitted if the edges of the ribs or cross pieces are rounded on the small side that faces away from the flow direction. For the same reason, it can be useful if the perforated plate contains a central flow hole, around which other flow holes are arranged in circular and especially concentric form.

To keep the noise derived from the production of the individual jets through the perforated plate as low as possible, it is useful if the flow holes in the perforated plate are rounded on the inflow side and/or are given a funnel-shaped taper in the flow direction. A rounding radius of at least 0.2 mm, preferably at least 0.6 to 0.8 mm, proved to be particularly advantageous. This rounding of the flow hole edge area on the inflow side achieves a laminar stream in the individual jets, which permits the flow holes in the perforated plate also to have a rounded edge area on the outflow side. This rounding on both sides of the flow holes prevents a production cost that would otherwise only occur with the comparatively short service life of the sharp edges that can be achieved with injection molding forms.

The thinnest possible wall configuration of the perforated plate also achieves good stream dispersion in the individual jets. Under the pressure of the water stream impacting on the perforated plate, particularly at high water temperatures, a thin-walled perforated plate can vibrate, thereby producing undesirable noise. Therefore, a further development of the invention provides for the perforated plate to have radially oriented reinforcing ribs on the flat outflow side.

The air mixing zone, which is adjacent to the perforated plate in the flow direction, can be particularly large if the perforated plate contains a dish-shaped longitudinal section, with the bottom of the dish located on the inflow side of the perforated plate.

BRIEF DESCRIPTION OF THE DRAWINGS

Other features of the invention can be found in the following description of a configuration example according to the invention, in conjunction with the claims and the drawings. The individual features can be used by themselves, or several can be joined into a configuration according to the invention. In the drawings:

DESCRIPTION OF THE PREFERRED EMBODIMENT

Figure 1:
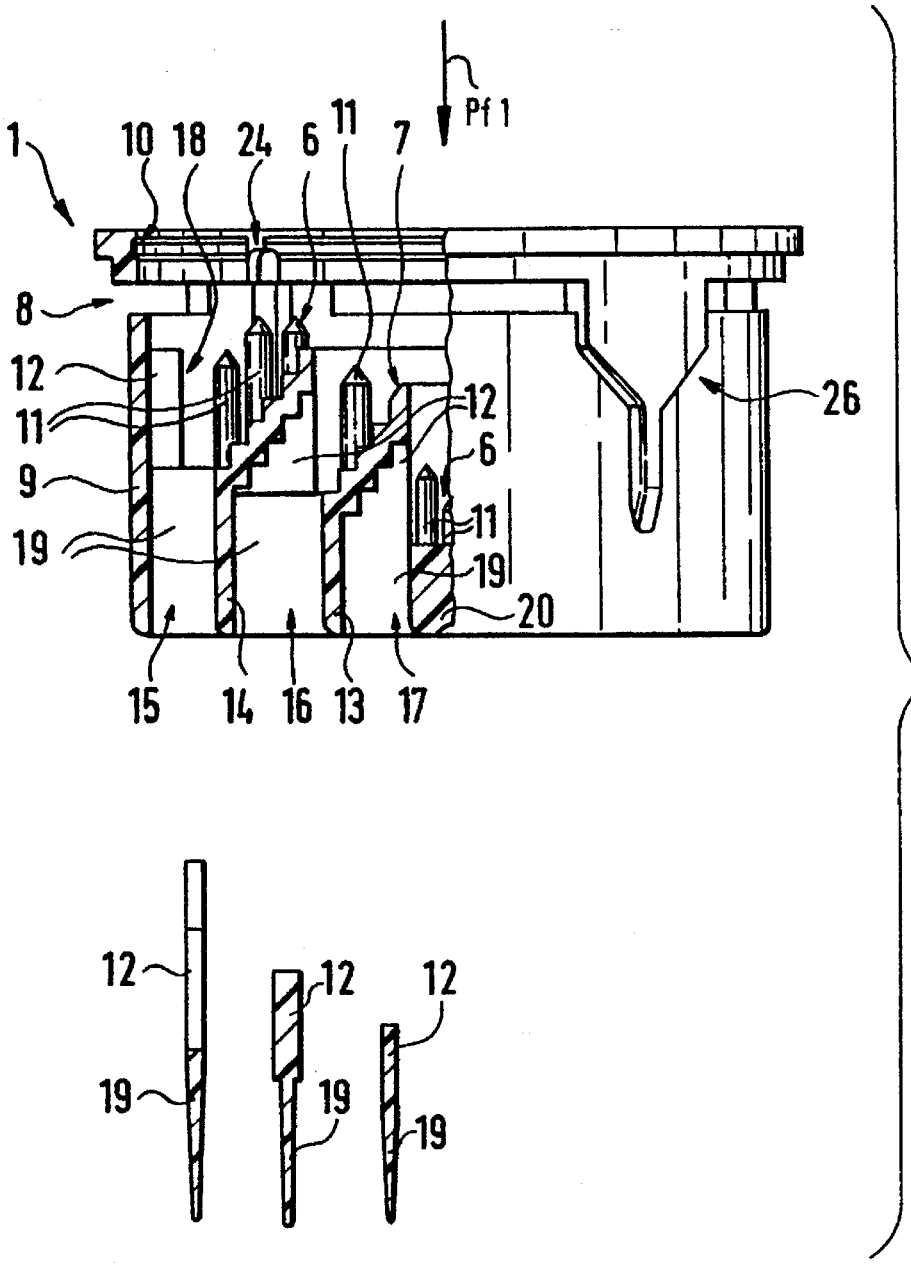
FIG. 1 is a partial longitudinal section through a jet regulator with only one perforated plate, which is followed by a number of pins and ribs arranged as flow obstacles in the flow direction, where the ribs under the jet regulator are depicted again in a longitudinal section displaced by 90°.
Figure 4:
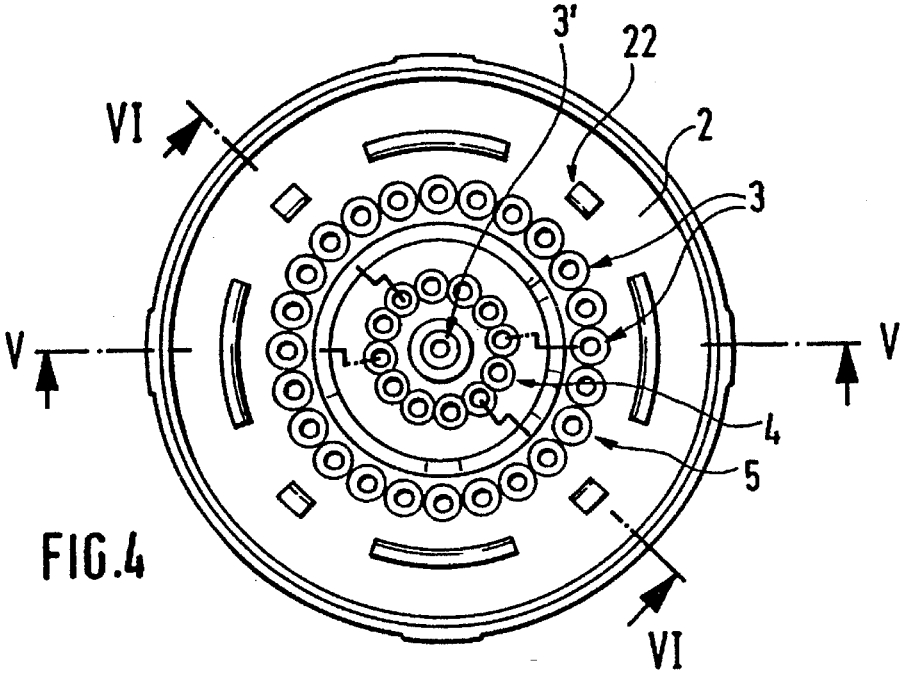
FIG. 4 is a top view of the perforated plate.

FIG. 1 depicts a partial longitudinal section of a jet regulator 1 for attachment to sanitary fittings or the like. The jet regulator 1 accommodates only one perforated plate 2 (not shown in FIG. 1; see FIGS. 4 to 8), which serves as a stream dispersion device. The perforated plate 2 (FIG. 4), which may be preceded in the flow direction by a strainer (not illustrated) contains a number of flow holes 3 arranged in two separate concentric hole circles 4, 5 around a central axial flow hole 3'. In this instance, the flow holes exhibit a round open cross section, but could also have square, hexagonal or similar multiple corner cross sections, at least in some areas.

The flow holes arranged in the two hole circles 4, 5 are equipped with deflection slopes 6, 7 (FIG. 1) at a distance from their outflow side. These are arranged at an angle to the flow direction Pf1, at least in the partial area to which the individual jets flow, and laterally deflect the individual jets impinging on them.

These deflection slopes 6, 7 cause a first slow-down of the water streams, which mix with the air that flows into the open area remaining between the deflection slopes 6, 7 and the perforated plate 2, and serves as an air mixing zone. This air is drawn in by the liquid streams through the air intake openings 8, provided as lateral openings on the outer jacket 9 of the jet regulator 1.

The perforated plate 2 illustrated in FIGS. 4 to 8 is placed perpendicular to the flow direction Pf1 in area 10 of jet regulator 1, in its outer jacket 9.

The deflection slopes 6, 7, which point sideways, are followed by pins 11 and ribs 12 approximately oriented in the lengthwise direction of the jet regulator 1, and serve as obstacles to the flow, causing additional slowing and splitting of the water streams, while mixing air into them. The free ends of these pins 11 point toward the perforated plate 2. All pin ends are approximately cone-shaped. It could also be possible to give the pin ends spherical shapes or similar, tapering toward the perforated plate 2.

As shown in FIG. 1, the cone-shaped ends of the pins placed in the outer hole circle 5 in perforated plate 2 in the outflow direction of flow holes 3 serve as deflection slopes 6, which divert the impacting individual jets produced by hole circle 5 towards the neighboring outer pins 11. In order to be able to divert the respective individual jets towards the outside, the pins 11, which are placed in the outer hole circle 5 and in the outflow direction, can be radially offset inward in relation to the passage axis of the flow holes 3. In this way the individual jets do not impact on the points of these pins 11, but on the outward facing surfaces of the respective conical pin ends.

The pins placed in the outer hole circle 5 of perforated plate 2 are arranged in three pin circles, where the inner pin circle is located in the outflow area of the corresponding flow holes 3 of hole circle 5. The pins 11 located in the two neighboring outer pin circles are staggered with respect to each other, so that the individual jets pass through a practical labyrinth formed by the rows of pins, where they are dispersed, significantly slowed down and mixed with air.

The common deflection slope 7 is assigned to the flow holes 3 located in the inner hole circle 4, where this slope is formed by the outward inclined front of a circular concentric inner ring wall 13, which faces perforated plate 2. An outside ring wall 14 is located between this inner ring wall 13 and the outer jacket 9 of jet regulator 1. Pins 11 outward the deflection slope 7, which are arranged in only one pin circle, located between the inner ring wall 13 and the outer ring wall 14. Pins 11 that are allocated to the outer hole circle 5 are located between the outer ring wall 14 and the neighboring outer jacket 9 of jet regulator 1. Ring channels 15, 16 and 17 through which water flows, are located between the outer jacket 9 and the outer ring wall 14; between the outer and the inner ring wall 14, 13 and also between the inner ring wall 13 and a central body 20 respectively. They are coaxially disposed with respect to the longitudinal axis of the jet regulator.

Similar to the conical ends of all pins 11 of jet regulator 1, the deflection slope 7 also has an inclination angle of about 40° with respect to the longitudinal axis of the jet regulator. As a consequence, the individual jets, which are produced by the inner hole circle 4, are deflected to the next outward pin circle, where they are slowed down and mixed with air.

Figure 2:
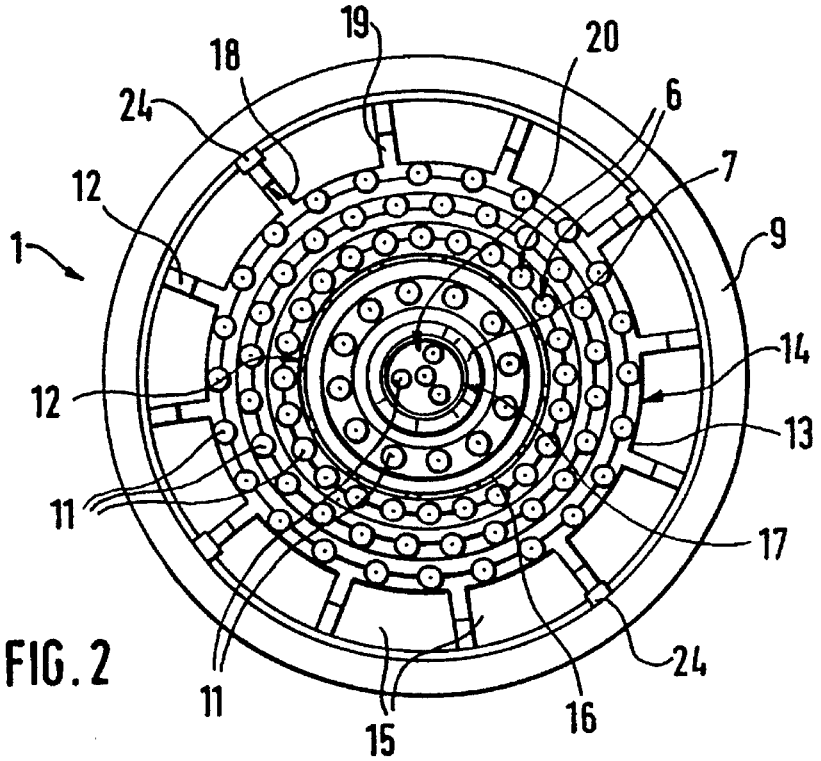
FIG. 2 is a top view of the jet regulator section in FIG. 1 arranged in the flow direction under the perforated plate.

To favor the slow-down of the individual jets and achieve a good mixture of these liquid streams with the drawn-in air, the ring walls 13, 14 are constructed in step or cascade form (as a circular tiered wedding cake) in the area facing the perforated plate 2 where the concentric "treads" of these steps are located respectively in planes that are approximately transverse to the flow direction, and the concentric "risers" of these steps are approximately located in the flow direction. The edges of the steps protruding into ring channels 15, 16 between surfaces of the steps on the outside of ring walls 13, 14 have sharp edges, to improve dispersion and air mixing of the individual jets. As shown in FIG. 2, the pins 11 are placed on the steps, the "treads" of which are shorter in dimension than the adjacent "risers".

Figure 9:
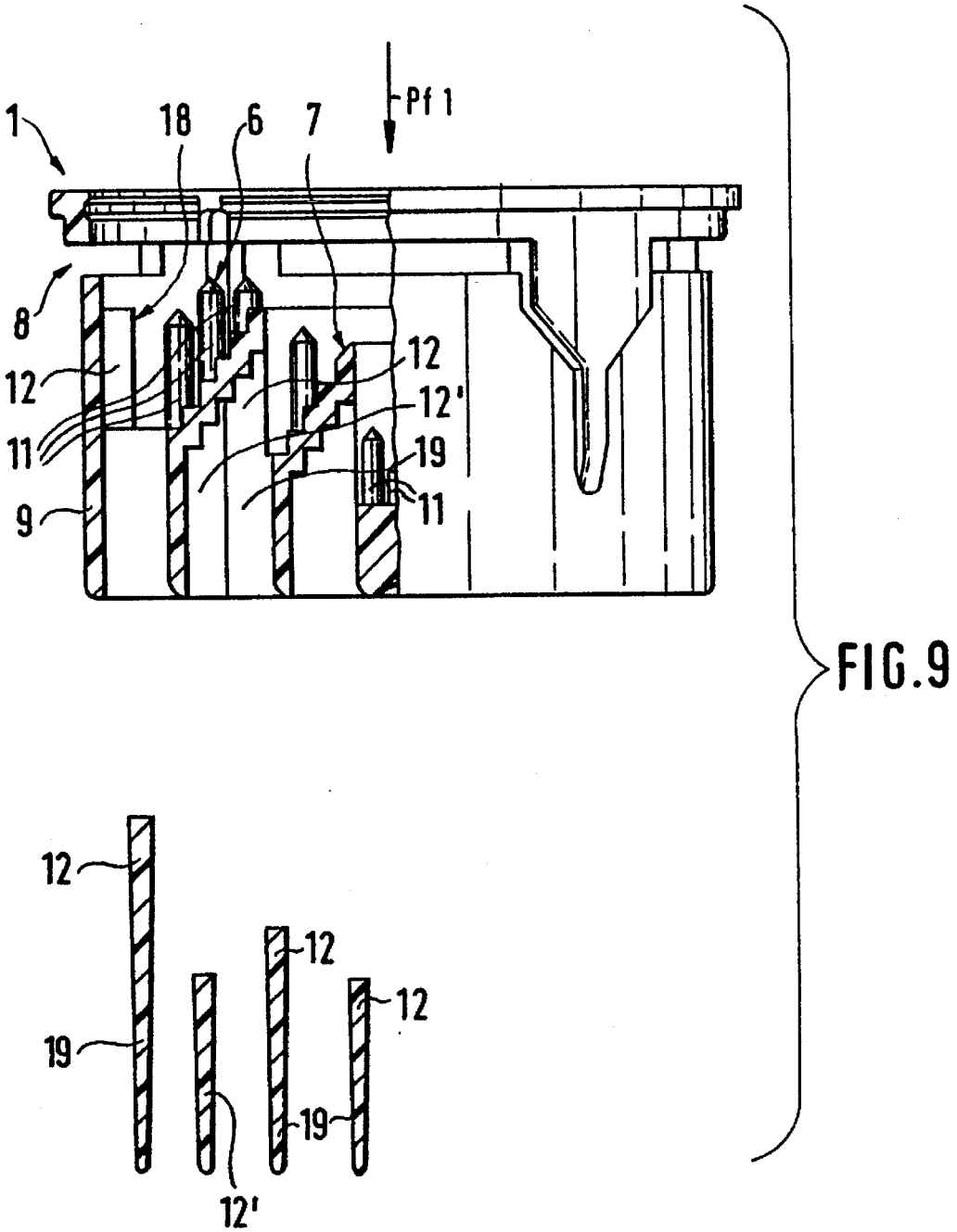
FIG. 9 is a partial longitudinal section similar to FIG. 1 of a modified jet regulator embodying the invention wherein the ribs and cross pieces of the taper conically in the flow direction along their full length.

The lengthwise-oriented ribs 12, which extend approximately in the radial direction and like pins 11 also serve as flow obstacles. Ribs 12 are located on the inside walls of the outer jacket 9 and on the inside of the two ring walls 13, 14. At least the small side or the front 18 of the ribs 12 ends spaced from the next inward ring wall 13, 14. As shown in FIG. 1, the thickness of the ribs 12 is approximately equal to the diameter of the pins 11 located on the adjacent inside ring wall 13, 14. For example, the thickness of the ribs 12 protruding into ring channel 16 corresponds approximately to the diameter of the pins 11 located in this ring channel 16. It may be an advantage for production reasons if the ribs 12 and cross pieces 19 are conically tapered toward the outflow side along their full length, regardless of the pin diameter, as illustrated in FIG. 9.

All ribs 12 are joined by radial connection pieces 19, which connect the inner wall of the regulator's outer jacket 9 with ring wall 14, or this ring wall 14 with the neighboring ring wall 13, and this ring wall 13 with the central body 20. The edges of these connection pieces 19 are rounded on the small side that faces away from the flow direction, which favors joining the individual jets and gives a harmonic aspect to the full stream flowing from the jet regulator. As shown in FIG. 9, partial other ribs 12' can be placed between ribs 12 and connection pieces 19 on the inside of ring walls 13, 14, and/or on the outer jacket 9, to additionally slow down the individual jets, where these additional ribs end at a distance spaced from the next inward ring wall and possibly from the central body.

Figure 3:
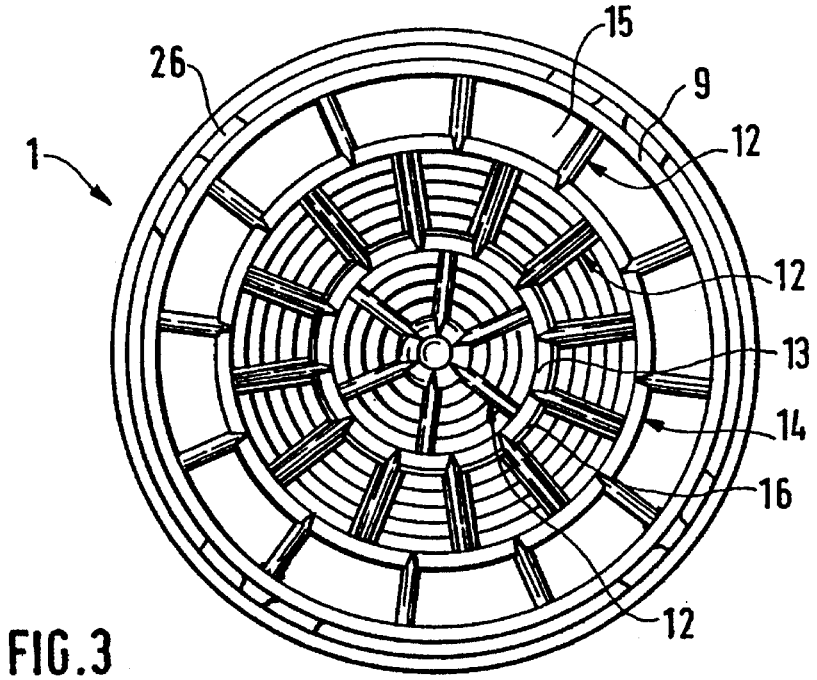
FIG. 3 is a bottom view of the jet regulator in FIGS. 1 and 2.

FIG. 3 makes clear that the ribs 12 and connection pieces 19, located between the individual walls, are evenly staggered and distributed around the circumference of ring channels 15, 16 and 17. It can be seen in FIG. 3 that the ring walls 13, 14 also have step or cascade-shaped gradations on the inside of their ring walls. The gradations inside the ring walls which expand in the flow direction, are designed to prevent an unfavorable backflow by any individual liquid stream against the flow direction Pf1.

As is clear from FIGS. 1 and 2, a pin 11 is located on the central body 20, coaxially with the central flow hole 3' of perforated plate 2. The free end of this pin which faces the perforated plate 2 and is also cone-shaped and acts as the deflection slope. Three other pins 11, which also serve as flow obstacles, are located at a small distance from this central pin 11. These three outer pins extend beyond the central pin 11, in order to catch the central divided individual jet.

Instead of the pins 11, the central body 20 may be formed with an outer surface which tapers on toward the perforated plate 2, at least in the area that faces the perforated plate 2. To provide the central individual jet with a high flow velocity as well, it can be useful if the central body 20 is cone-shaped, at least in the area that faces perforated plate 2, or if it has step or cascade-shaped gradations, similar to ring walls 13, 14. In turn, the central body can also have several flow holes to additionally divide the central individual jet.

Figure 5:
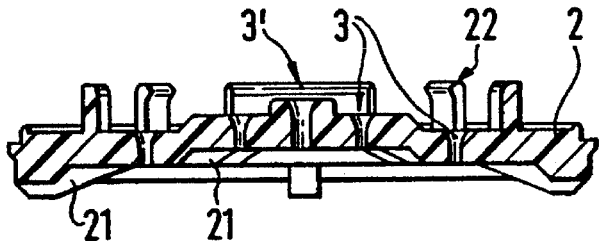
FIG. 5 is a longitudinal section of the perforated plate through plane V—V in FIG. 4.
Figure 6:
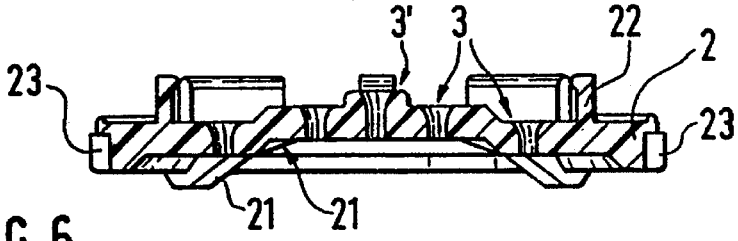
FIG. 6 is a longitudinal section of the perforated plate through plane VI—VI in FIG. 4.

The longitudinal sections in FIGS. 5 and 6 make clear that the perforated plate is dish-shaped, where the bottom of the dish opposes the flow direction Pf1. The perforated plate 2 has radially oriented reinforcing ribs 21 on the flat outflow side, which permit the perforated plate 2 to have thin walls, without incurring excess vibrations under the pressure of the water jet.

To maintain the noise produced by the individual jets as low as possible, the flow holes 3, 3' of perforated plate 2 are rounded on the inflow side and have a funnel-shaped taper in the flow direction Pf1. A rounding radius of about 0.6 to 0.8 mm has proved to be useful for the edges on the inflow side of the flow holes 3, 3'. The rounded edges of the flow holes 3, 3' guide the individual jets in a laminar stream without heavy turbulence. This laminar stream also permits a slight rounding of the edges on the outflow side of the flow holes 3. The rounded edges of flow holes 3 facilitate production of the jet regulator 1 and its perforated plate 2, as well as improve long service life of the injection molds being used to make it.

Several catch hooks 22 are provided on the top front surface of perforated plate 2, which serve to affix a strainer attachment, not illustrated here. The spacing of the pins 11 assigned to hole circles 4, 5 is influenced by the diameter of the flow holes of the strainer attachment, as well as to the perforated plate 2 located downstream in the flow direction. The spacing of these pins 11 from each other corresponds to, or is larger than, the open diameter of these flow holes. In this way dirt particles, which have reached the inside of the jet regulator 1 through the strainer attachment (not shown) and the perforated plate 2, are also able to pass between pins 11.

The pins 11 exhibit a round cross section in FIGS. 1 and 2. In order to possibly achieve an additional slow-down by means of the pins 11, these could also have a hexagonal, octagonal or similar non-circular cross section. As is clear from FIGS. 1 and 2, all pins 11 have a cone-shaped or similarly tapered end, to prevent excessive splitting of the individual jets they catch.

Figure 7:
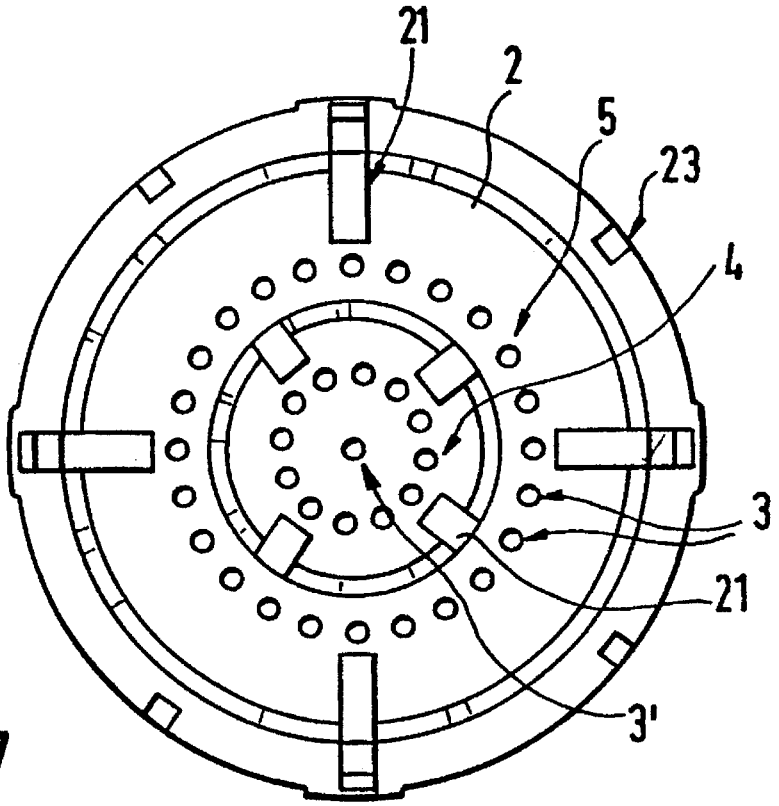
FIG. 7 is a bottom view of the perforated plate in FIGS. 4 to 6, which clearly shows the flow holes arranged in two perforate circles.
Figure 8:
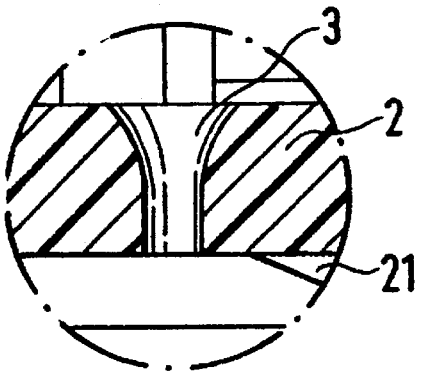
FIG. 8 is an enlarged fragmentary partial longitudinal section of the area of one of the flow holes in the perforated plate of FIGS. 4 to 7.

As shown in FIG. 1, the outflow edges of ring walls 13, 14 are rounded on the outside wall, while the opposing inside wall has sharp edges. The rounded edges on the outside wall of ring walls 13, 14 combine the individual jets well, and provide a homogeneous aspect to the full stream. FIGS. 6 and 7 depict four cutouts 23 on the underside of perforated plate 2, which are evenly spaced around the plate circumference and serve to position the perforated plate 2 in the jet regulator 1. The cutouts 23 coincide with the positioning noses 24 placed on four of the ribs 12 that protrude inward with the outer jacket 9 of jet regulator 1. These four ribs 12 serve to support perforated plate 2.

The perforated plate 2 illustrated in FIGS. 4 to 8 locks onto the sleeve-shaped part of jet regulator 1 illustrated in FIGS. 1 to 3, or is attached in similar removable form. The sleeve-shaped part of jet regulator 1 illustrated in FIG. 1, which is a plastic injection molded part like the perforated plate 2, has four equally spaced centering or positioning projections 26 on its outer jacket 9, which facilitate the precise reception and positioning of these sleeve-shaped parts in the machines used to produce the jet regulator 1.

Figure 10:
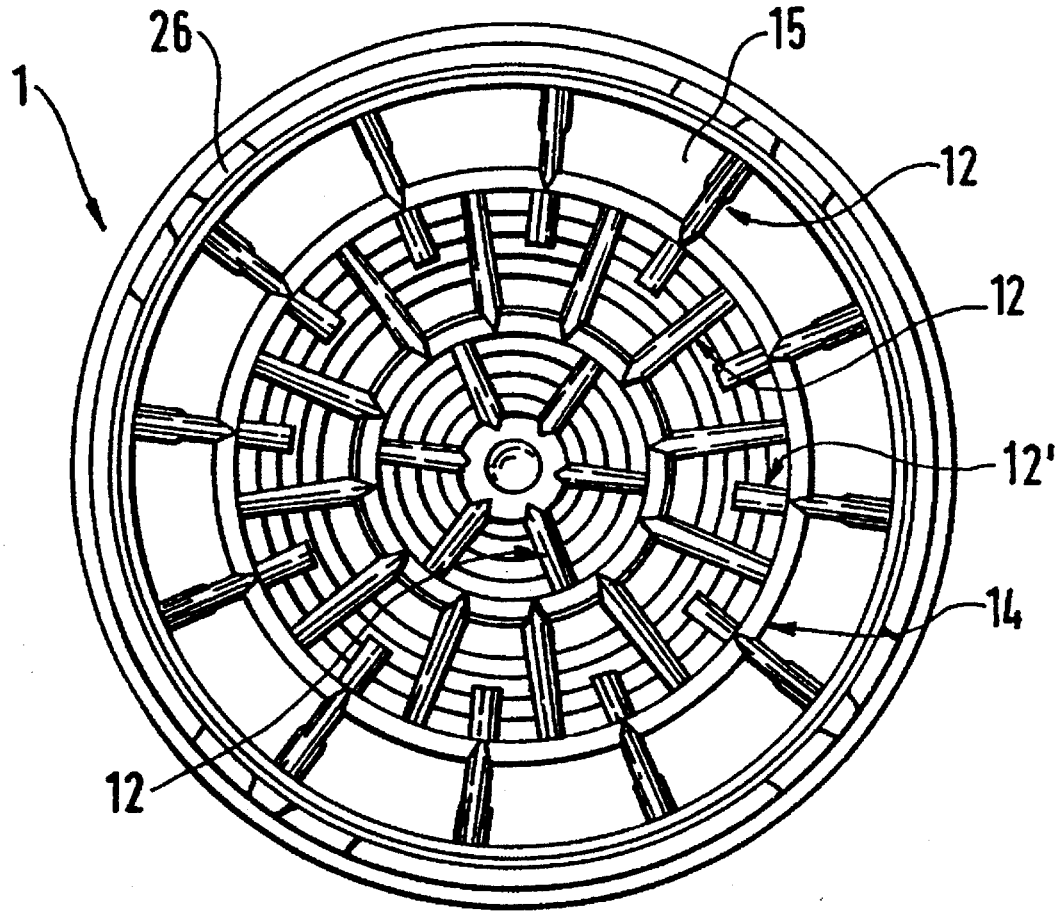
FIG. 10 is a bottom plan view of the jet regulator of FIG. 9.

FIGS. 9 and 10 illustrate a jet regulator 1, which coincides mostly with the jet regulator illustrated in FIGS. 1 to 8. The jet regulator 1 in FIGS. 9 and 10 has ribs 12, which are conically tapered toward the outflow side, together with their one-piece connection pieces 19. Between these ribs 12, which blend into the connection pieces 19, additional ribs 12' are provided in at least one of the ring channels, in this instance ring channel 16, where these ribs 12' end spaced from the next inward ring wall 13 and approximately extend to the outflow side of ring walls 13, 14. All the ribs 12, 12' are rounded on their small outflow side, to favor the harmonic concentration of the individual jets into a full aerated stream.

The configuration with its conical ribs 12 and connection pieces 19, depicted in FIGS. 9 and 10, is particularly easy to remove from a corresponding injection mold.

The jet regulator 1, consisting of the sleeve-shaped part and perforated plate 2, is located in a jet regulator housing that is not illustrated here, which can be attached by means of an internal or external thread to the external or internal thread of a water fitting. Because of the low height of the jet regulator of the invention, other conventional jet regulator housings can also be used, therefore the jet regulator of the invention has multiple applications.

Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. A stream softener and aerator adapted to be installed in a water supply fitting comprising a. a perforated circular plate having flow holes arranged in concentric circles about its axis;

b. a sleeve coaxial with the plate and having the plate secured to its upstream end, the sleeve having supported concentrically within it a first circular ring wall having spaced annular surfaces perpendicular to the axis and being of decreasing outer diameter in the upstream direction, the wall having formed thereon a plurality of pins having their distal ends aimed toward the plate and deflection slopes on said distal ends at least some of the pins being aligned with flow holes respectively in the plate so that jets from the holes will engage the deflection slopes and be deflected outward, and means in the sleeve for introducing air into the space between the plate and the deflection slopes.

2. A stream softener and aerator as claimed in claim 1 wherein the sleeve is additionally formed with radial inward ribs which stop short of the wall and the wall is formed downstream of the first-mentioned pins with additional pins extending in the direction of the plate, the ribs and additional pins forming obstacles to the flow of water from the deflection slopes.

3. A stream softener and aerator as claimed in claim 2 wherein the additional pins are radially staggered with respect to the first-mentioned pins.

4. A stream softener and aerator as claimed in claim 1 wherein at least some of the flow holes are aligned with a common outflow slope which comprises the upstream surface of a second circular ring wall axial with the sleeve and inside the first ring wall.

5. A stream softener and aerator as claimed in claim 1 wherein the circular ring wall has sharp edges on the outside of the annular surfaces.

6. A stream softener and aerator as claimed in claim 2 wherein the wall is supported in the sleeve by radial connecting pieces and the radial connection pieces are tapered toward the outflow side along their entire length.

7. A stream softener and aerator as claimed in claim 1 wherein the flow holes of the perforated plate are rounded on the inflow side, and have a funnel-shaped taper in the flow direction.

8. A stream softener and aerator as claimed in claim 1 wherein the plate has a central flow hole and the sleeve supports a coaxially located pin whose free end which faces the perforated plate comprises a deflection slope.

9. A stream softener and aerator as claimed in claim 8 wherein the coaxially located pin is cone-shaped in the area that faces the perforated plate.

10. A flow controller and aerator for attachment to a faucet comprising a tubular sleeve adapted to be disposed axially of the flow, a perforated plate adapted to be disposed on the upstream side of the sleeve transverse to the flow, the plate being formed with a number of holes, a first circular ring wall concentrically supported in the sleeve, deflection slopes supported on the wall in the form of pins having their distal ends conical and directed toward the plate to deflect jets emanating from the holes in a direction outward with respect to the centerline of the sleeve, and means for drawing air into the space between the holes and the deflection slopes.

11. A flow controller and aerator as claimed in claim 10 wherein the first circular ring wall is step-like, the first circular ring wall narrowing toward the plate, said circular ring wall supporting the pins, and additional obstacles to flow are disposed outward and downstream of the pins.

12. A flow controller and aerator as claimed in claim 11 wherein a second annular step-like circular ring wall is disposed concentric inside and spaced from said first annular step-like ring wall whereby water can flow between said walls.

13. A flow controller and aerator as claimed in claim 11 wherein the additional obstacles are additional pins on the step-like walls outward of the deflection slopes.

14. A flow controller and aerator as claimed in claim 12 wherein the second ring wall is supported by radial connection pieces which also comprise said additional obstacles.

15. A flow controller and aerator as claimed in claim 14 wherein the connection pieces are tapered, narrowing in the downstream direction.

16. A flow controller and aerator as claimed in claim 12 wherein inwardly extending radial ribs are attached to the sleeve and are spaced from the first circular ring wall thereinside to comprise the additional obstacles to flow.

17. A flow controller and aerator as claimed in claim 12 wherein the second circular ring wall is also provided with deflection slopes.

18. A flow controller and aerator as claimed in claim 12 wherein the deflection slopes on the second circular ring wall has at its upper end a downward and outward inclined surface.

19. A flow controller and aerator as claimed in claim 17 wherein the deflection slopes on the second circular ring wall include the conical upper ends of pins mounted on the second circular ring wall, said pins on the second annular wall being aligned with holes in the plate.

20. A flow controller and aerator as claimed in claim 19 wherein a central body is supported in the sleeve and carrying a further deflection slope, said deflection slope being aligned with a central hole in the plate.

* * * * *